US005466123A

United States Patent [19]

Rose

[11] Patent Number: 5,466,123

[45] Date of Patent: Nov. 14, 1995

[54] GAS TURBINE ENGINE TURBINE

[75] Inventor: Martin G. Rose, Derby, England

[73] Assignee: Rolls-Royce plc, London, England

[21] Appl. No.: 255,970

[22] Filed: Jun. 7, 1994

[30] Foreign Application Priority Data

Aug. 20, 1993 [GB] United Kingdom ..... 9317410

[51] Int. Cl.[6] ..... F04D 29/28

[52] U.S. Cl. ..... 415/182.1; 415/914

[58] Field of Search ..... 415/182.1, 914

[56] References Cited

U.S. PATENT DOCUMENTS 2,918,254 12/1959 Hausammann ..... 415/914

4,420,288 12/1983 Bischoff ..... 415/914

4,677,828 7/1987 Matthews et al. ..... 415/914

5,215,439 6/1993 Jansen et al. ..... 415/914

5,397,215 3/1995 Spear et al. ..... 415/191

*Primary Examiner*—John T. Kwon

*Attorney, Agent, or Firm*—Cushman Darby & Cushman

[57] ABSTRACT

A gas turbine engine turbine is provided with an annular array of nozzle guide vanes which define a radially inner annular platform. The radially outer surface of the platform is configured so as to define a plurality of convex and concave portions. These portions are so arranged as to vary the static pressure of the gases which operationally flow across the vanes in such a manner that the static pressure in the field immediately downstream of the vanes is substantially circumferentially uniform.

7 Claims, 3 Drawing Sheets

GAS TURBINE ENGINE TURBINE

FIELD OF THE INVENTION

This invention relates to a turbine for a gas turbine engine and is particularly concerned with reducing the amount of air which is used for cooling purposes in such a turbine.

BACKGROUND OF THE INVENTION

Gas turbine engine turbines conventionally comprise axially alternate annular arrays of stator vanes and rotor blades. The rotor blades are usually mounted on the periphery of a rotatable disc adjacent the stator vanes. In order to ensure that rotatable and static components do not contact each other under normal operating conditions, an annular gap has to be provided between the stator vanes and the bladed rotor. This presents a problem, however, in that precautions have to be taken to ensure that the hot gases which normally pass through the turbine do not leak through the annular gap. Such leakage would be highly undesirable in view of the loss in turbine efficiency which would occur and overheating of the rotor disc and static structure adjacent to it.

The conventional method of addressing this problem of hot gas leakage is to supply high pressure cooling air to the gap between the stator vanes and the bladed rotor. Thus cooling air is directed radially outwardly over the surface of the rotatable disc and adjacent static structure to exhaust through the gap into the hot gas stream. Obviously for the cooling air to be exhausted through the gap its pressure must be greater than that of the hot gas stream. In practice, cooling air has to be exhausted through the gap at a significantly higher pressure than the mean static pressure in the field which is immediately downstream of the stator vane exits. This, in turn, leads to the use of a greater amount of cooling air than would otherwise be anticipated.

The reason for the use of higher pressure cooling air is the variation in static pressure which occurs in the field downstream of the stator vanes. Thus the static pressure varies so that in some parts of the field, it is significantly higher than in other parts. More specifically, the static pressure varies circumferentially in a roughly sinusoidal manner. Consequently the pressure of the cooling air exhausted through the gap must be higher than the highest pressure peak in the stator vane exhaust field.

It will be clearly apparent that such excessive use of cooling air is highly undesirable in view of the loss of mass flow which it provides to the overall engine cycle as well as the efficiency losses which it causes to the rotor blades which are immediately downstream of the annular clearance.

SUMMARY OF THE INVENTION

It is an object of the present invention to provide a turbine having an annular array of aerofoil members having associated structure which is so configured as to reduce such variations in static pressure in the field which is immediately downstream of the aerofoil members.

According to the present invention, a turbine suitable for a gas turbine engine comprises an annular array of aerofoil members, at least the radially inner extents of said aerofoil members being interconnected by an annular platform, said annular platform being so configured as to provide variation in the static pressure of the gases which operationally flow across said aerofoil members in such a manner that the static pressure of said gases in the field immediately downstream of said annular array is generally circumferentially uniform.

By ensuring that there is generally uniform circumferential static pressure in the field immediately downstream of the annular array, undesirable peaks of static pressure are avoided. As a consequence, the pressure of the cooling air exhausted through the gap between the stator vanes and the bladed rotor need only be greater than the mean static pressure in the field downstream of the stator vanes, not the peak static pressure. Consequently less cooling air is required.

BRIEF DESCRIPTION OF THE DRAWINGS

The present invention will now be described, by way of example, with reference to the accompanying drawings in which.

DETAILED DESCRIPTION OF THE INVENTION

Figure 1:
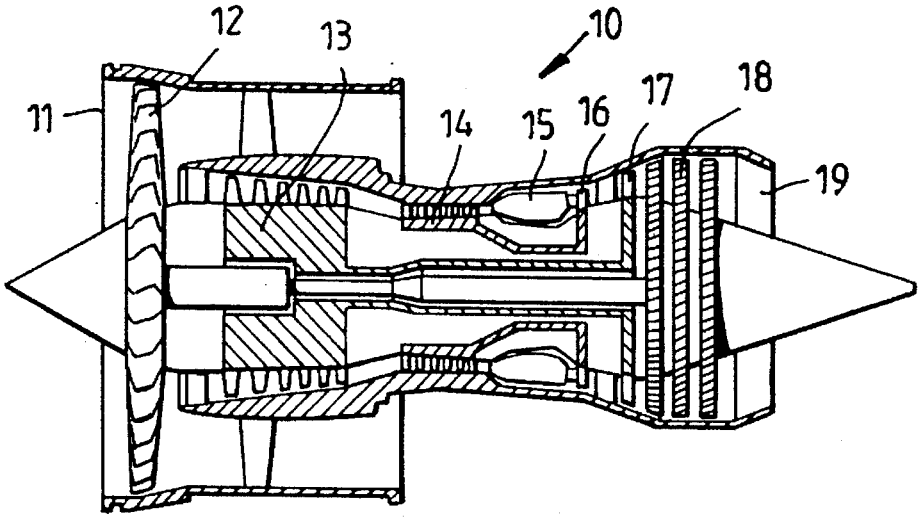
FIG. 1 is a schematic sectioned side view of a ducted fan gas turbine engine which incorporates a turbine in accordance with the present invention.

With reference to FIG. 1, a ducted fan gas turbine engine generally indicated at 10 is of conventional configuration comprising an air intake 11, ducted fan 12, intermediate and high pressure compressors 13 and 14 respectively, combustion equipment 15, high, intermediate and low turbines 16, 17 and 18 respectively and an exhaust nozzle 19.

The gas turbine engine 10 functions in the conventional manner. Air drawn in through the intake 11 is accelerated by the fan 12 and then divided into two flows, the larger of which is exhausted to atmosphere to provide propulsive thrust. The smaller flow is directed into the intermediate pressure compressor 13 where it is compressed prior to being directed into the high pressure compressor 14 where further compression takes place. The compressed air is then directed into the combustion equipment 15 where it is mixed with fuel and the mixture combusted. The resultant hot combustion products then expand through, and thereby drive, the high, intermediate and low pressure turbines 16, 17 and 18 before being exhausted to atmosphere through the exhaust nozzle 19 to provide additional propulsive thrust.

Suitable concentric shafts provide power communication between the various turbines and compressors in the conventional manner.

Figure 2:
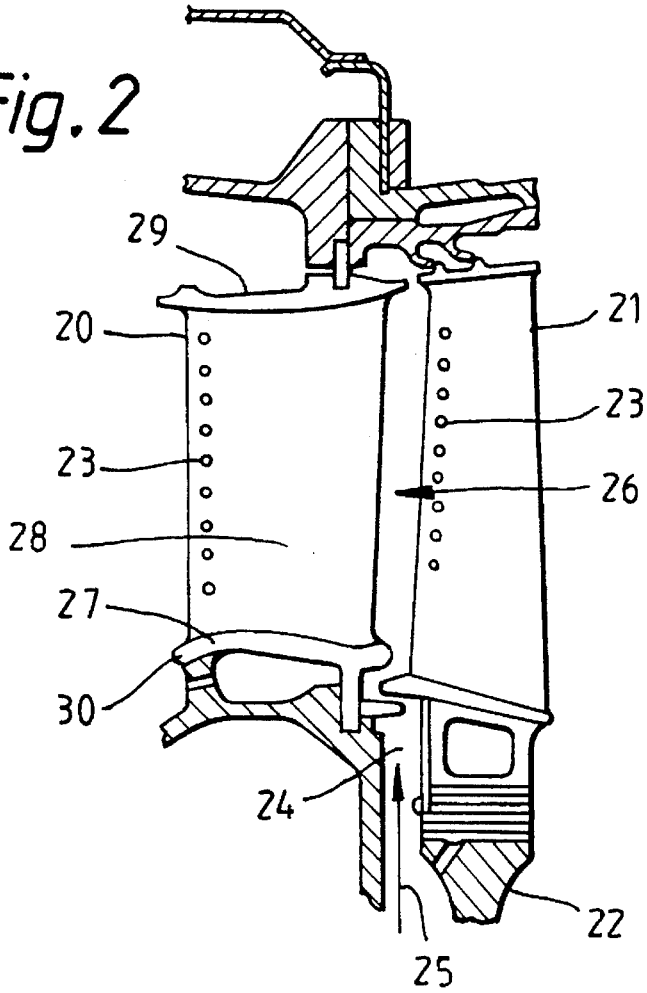
FIG. 2 is a side view of a part of the high pressure turbine of the ducted fan gas turbine engine shown in FIG. 1 showing a nozzle guide vane and the aerofoil rotor blade downstream of it.

At the upstream end of the high pressure turbine 16 there is provided an annular array of radially extending nozzle guide vanes 20 as can be seen more clearly if reference is now made to FIG. 2. The nozzle guide vanes 20 direct the hot combustion products from the combustion equipment 15, at an appropriate angle, on to an annular array of radially extending rotor aerofoil blades 21 located immediately downstream thereof. The rotor aerofoil vanes 21 are mounted by conventional means to the periphery of a rotor disc 22.

Cooling air is directed to the interiors of both the nozzle guide vanes 20 and the rotor aerofoil blades 21 by conventional means. The air is exhausted through a plurality of small holes 23 to provide film cooling of the external surfaces of the vanes and blades 20 and 21.

Since the nozzle guide vanes 20 are static and the rotor aerofoil blades are rotary, an axial annular clearance gap 24 is necessarily provided between them. Clearly the gap 24 is arranged to be as small as possible in order to avoid some of the hot combustion product gases flowing over the vanes 20 and blades 21 leading through the gap 24 to cause overheating of the disc 22. However, in practice, the gap 24 varies axially as the engine 10 expands and contracts over typical engine operating cycles, thereby making effective sealing of the gap 24 extremely difficult. This problem is solved in a conventional manner by the provision of a flow of cooling air through the gap 24 in a radially outward direction as indicated by the arrow 25.

The static pressure of the hot combustion products in the field 26 immediately downstream of the nozzle guide vanes 20 conventionally varies circumferentially. Consequently under normal circumstances, the pressure of the cooling air exhausting radially outwardly through the gap 24 would have to be higher than the highest pressure in the field 26. However in accordance with the present invention, the radially inner circumferentially extending platform 27 of the nozzle guide vanes 20 is modified in configuration in order to provide uniformity of the static pressure within the field 26.

The nozzle guide vanes 20 comprise aerofoil vanes 28, which are linked at their radially inner and outer extents by common radially inner and outer platforms 27 and 29 respectively. The radially inner and outer platforms 27 and 29 are made up of a plurality of adjacent pieces to define radially inner and outer annular boundaries to the hot combustion product flow over the aerofoil vanes 28. In conventional nozzle guide vane arrays, both the radially inner and outer platforms are axisymmetric about the longitudinal axis of the engine 10. However in the case of the present invention, this not true of part of the radially inner platform 27.

Figure 3:
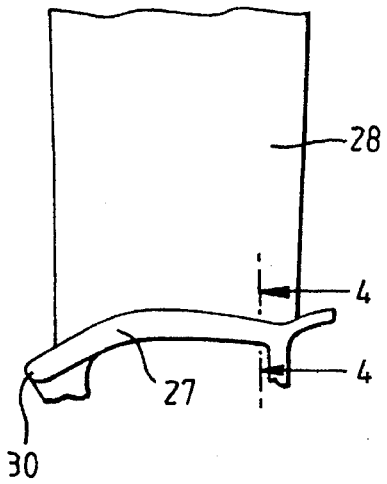
FIG. 3 is a side view on an enlarged scale of the radially inner part of the nozzle guide vane shown in FIG. 2.
Figure 4:
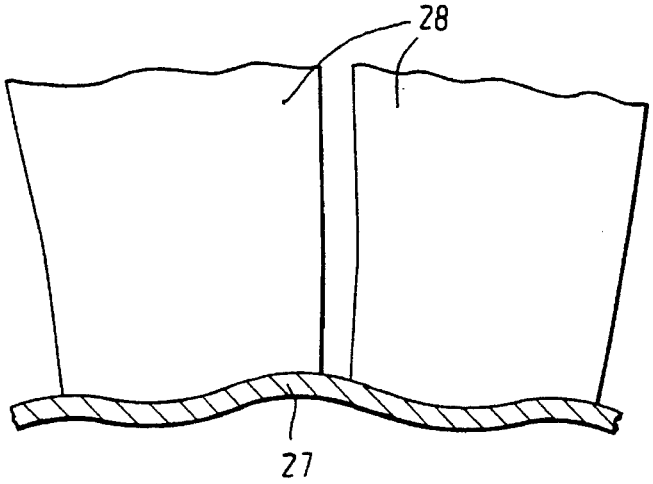
FIG. 4 is a view on arrows 4—4 of FIG. 3.

The upstream end 30 of the radially inner platform is generally axisymmetric. However downstream of that upstream end 30, the radial extent of the radially inner platform 27 varies circumferentially. In fact, the circumferential variation is generally sinusoidal in form. This can be seen more easily if reference is now made to FIGS. 3 to 6. FIGS. 4 and 6 in particular show the circumferential sinusoidal form of the radially inner platform 27.

In addition to the circumferential sinusoidal form of the radially inner platform 27, the platform 27 also varies in configuration in the general direction of gas flow over the nozzle guide vanes 20. Specifically, the radially inner platform 27 circumferentially alternates between a streamwise convex configuration and streamwise concave configuration. The two configurations can be seen if reference is made to FIGS. 3 and 5: FIG. 3 showing the concave configuration and FIG. 5 the convex.

Figure 5:
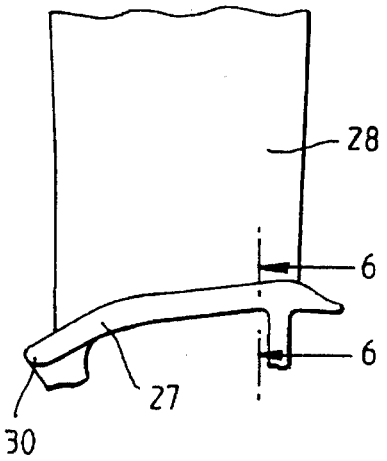
FIG. 5 is a view similar to that shown in FIG. 3 but taken at a different circumferential location.
Figure 6:
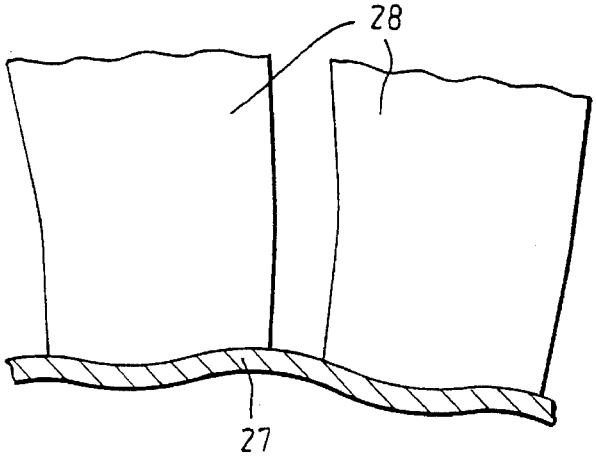
FIG. 6 is a view on arrows 6—6 of FIG. 5.
Figure 7:
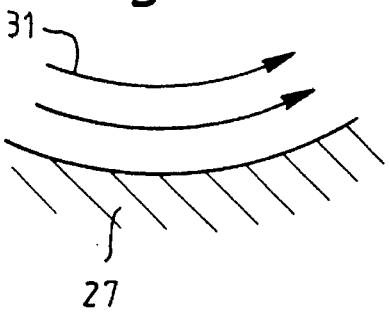
FIG. 7 is a sectioned side view, in exaggerated form, of part of the radially inner platform of the nozzle guide vane shown in FIG. 3.
Figure 8:
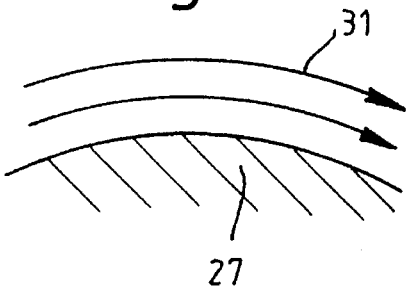
FIG. 8 is a sectioned side view, in exaggerated form, of part of the radially inner platform of the nozzle guide vane shown in FIG. 3 at a different circumferential location to that of the view shown in FIG. 7.

The configurations of FIGS. 3 and 5 are shown in exaggerated form in FIGS. 7 and 8 respectively. The exaggeration is provided in order to ensure that the manner of operation of the present invention may be more clearly understood. In FIGS. 7 and 8, the arrows 31 indicate the direction of flow of the hot combustion products in the immediate vicinity of the radially outer surface of the radially inner platform 27. Where the surface is concave as shown in FIG. 7, the gas flow over it is constrained to accelerate in a radially outward direction. Conversely where the surface is convex as shown in FIG. 8 the gas flow over it is constrained to accelerate in a radially inward direction.

The radially outward acceleration of the combustion product flow shown in FIG. 7 is a result of elevated pressure at the surface of the radially inner platform 27 and a drop in pressure radially outwardly of the surface. Likewise, the radially inward acceleration of the combustion product flow shown in FIG. 8 is as a result of low pressure at the surface of the radially inner platform 27 and an increase in pressure radially outwardly of the surface.

The magnitude and circumferential location of the axially convex and concave portions of the radially inner platform 27 are arranged so that the pressure variations which they create counteract the pressure variations which would otherwise exist in the field 26. As a consequence, the static pressure in the field 26 is generally circumferentially uniform. This means that the pressure of the cooling air flow 25 which is exhausted through the annular gap 24 into the field 26 need only be greater than the uniform static pressure in the field 26. It is not necessary for the pressure of the flow 25 to be higher than some peak pressure in the field 26. There is therefore greater economy of use of the cooling issued through the gap 24, thereby leading in turn to improved overall engine efficiency.

Figure 9:
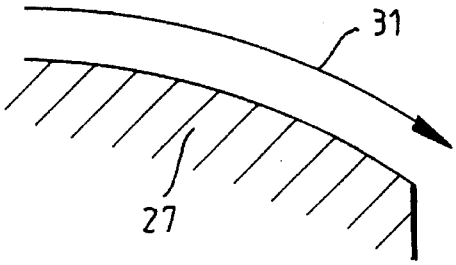
FIG. 9 is a sectioned side view, in exaggerated form, of the trailing edge region of the part of the radially inner platform of the nozzle guide vane shown in FIG. 3.
Figure 10:
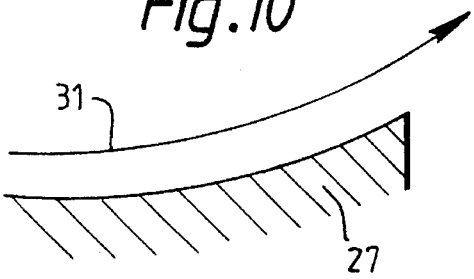
FIG. 10 is a sectioned side view, in exaggerated form, of the trailing edge region of part of the radially inner platform of the nozzle guide vane shown in FIG. 3 at a different circumferential location to that of the view shown in FIG. 9.
Figure 11:
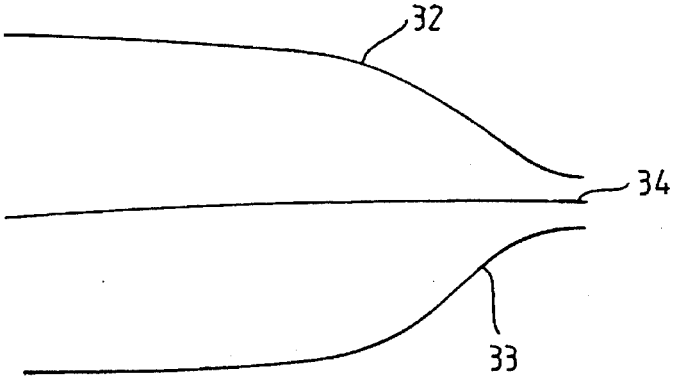
FIG. 11 is a schematic cross-sectional side view of the trailing edge region of part of the radially inner platform of the nozzle guide vane shown in FIG. 3 in a different embodiment of the present invention.

It will be appreciated that the platform 27 configuration described above will result in circumferentially alternate radially inward and outward downstream trailing edges to the platform 27, similar to those shown in exaggerated form in FIGS. 9 and 10. This will mean, of course, that the total circumferential extent of the downstream end of the platform 27 will be of sinusoidal configuration, i.e. it will be non-axisymmetric. It may, under certain circumstances, be undesirable to have such a non-axismymmetric trailing edge. If this is the case, the configuration shown in FIG. 11 could be utilized. In FIG. 11, which is shown in schematic form, the streamwise convex and concave inner platform 27 surfaces respectively shown at 32 and 33 converge to a mean position constituted by the trailing edge 34 of the radially inner platform 27. This results in some degree of inflection in the axially convex and concave surfaces of the radially inner platform 27. However in practice, such inflections are unlikely to have a significantly prejudiced effect upon the effective functioning of the present invention.

Although the present invention has been described with reference to an annular array of stator vanes, it will be appreciated that it need not necessarily be so limited. It could, for instance, be applied to an annular array of rotor aerofoil blades.

It will also be appreciated that although a major part of the radially inner platform 27 is shown as being configured to provide pressure variation in the gases flowing over it, this need not be absolutely necessary. It is only essential that the radially outer surface of the radially inner platform is appropriately configured.

I claim:

1. A turbine suitable for a gas turbine engine comprising an annular array of aerofoil members and an annular platform, at least the radially inner extents of said aerofoil members being interconnected by said annular platform, said annular platform providing variation in the static pressure of the gases which operationally flow across said aerofoil members in such a manner that the static pressure of said gases in the field immediately downstream of said annular array is generally circumferentially uniform, said annular platform having an axial extent including a radially outer surface, portions of at least part of said axial extent of said radially outer surface being one of a convex and concave shape in the direction of flow of said gases across said aerofoil members to provide variation in the static pressure of the gases which operationally flow over said aerofoil members, said convex and concave portions of said radially outer surface circumferentially alternating with each other.

2. A turbine as claimed in claim 1 wherein at least part of the axial extent of said radially outer surface of said annular platform is of circumferentially generally sinusoidal cross-section configuration.

3. A turbine as claimed in claim 1 wherein said annular platform has a trailing edge which is of generally axisymmetric configuration.

4. A turbine as claimed in claim 1 wherein said annular platform is constituted by a plurality of circumferentially adjacent members.

5. A turbine as claimed in claim 1 wherein said aerofoil members are stator vanes.

6. A turbine as claimed in claim 5 wherein an annular array of rotor aerofoil blades is provided downstream of said stator vanes so that an annular gap is defined between the radially inner extents of said stator vanes and rotor blades through which a flow of cooling air may be passed through said annular gap and into said field immediately downstream of said stator vanes.

7. A turbine as claimed in claim 1 wherein said aerofoil members are rotor aerofoil blades.

* * * * *